US006241000B1

(12) United States Patent
Conroy et al.

(10) Patent No.: US 6,241,000 B1
(45) **Date of Patent: *Jun. 5, 2001**

(54) METHOD FOR REMOVING CORES FROM CASTINGS

(75) Inventors: Patrick L. Conroy, Oceana; Harold C. Pierson, Muskegon; Michael M. McRae, Spring Lake, all of MI (US)

(73) Assignee: Howmet Research Corporation, Whitehall, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/485,377

(22) Filed: Jun. 7, 1995

(51) Int. Cl.[7] ..... B22D 29/00
(52) U.S. Cl. ..... 164/132; 134/152; 134/166 R
(58) Field of Search ..... 164/131, 132; 134/134, 152, 166 R

(56) References Cited

U.S. PATENT DOCUMENTS

| | | | | |
|---|---|---|---|---|
| 2,638,645 | | 5/1953 | Olson . | |
| 2,644,472 | | 7/1953 | Ward . | |
| 2,786,480 | | 3/1957 | Hofer . | |
| 3,070,104 | | 12/1962 | Faust et al. . | |
| 3,486,938 | | 12/1969 | Dubitsky . | |
| 3,590,863 | | 7/1971 | Faust et al. . | |
| 3,645,791 | | 2/1972 | Sadwith . | |
| 3,799,178 | | 3/1974 | Anderson et al. . | |
| 4,134,777 | | 1/1979 | Borom . | |
| 4,141,781 | | 2/1979 | Greskovich et al. . | |
| 4,569,384 | | 2/1986 | Mills . | |
| 4,708,153 | | 11/1987 | Hambleton et al. . | |
| 4,741,351 | | 5/1988 | Minkin . | |
| 4,836,268 | * | 6/1989 | Devendra | 164/132 |
| 5,332,023 | * | 7/1994 | Mills | 164/132 |
| 5,507,306 | * | 4/1996 | Irvines et al. | 134/166 R |

FOREIGN PATENT DOCUMENTS

| | | | | |
|---|---|---|---|---|
| 1 271 910 | | 7/1968 | (DE) . | |
| 24 14 167 | | 10/1975 | (DE) . | |
| 27 46 405 | | 4/1979 | (DE) . | |
| 2316024 | | of 1977 | (FR) . | |
| 1549220 | * | 7/1979 | (GB) . | |
| 2171932 | | 9/1986 | (GB) . | |
| 2266677 | | 11/1993 | (GB) . | |
| 63-256239 | | 10/1988 | (JP) . | |
| 470365 | * | 7/1975 | (SU) | 164/132 |
| 872024 | | 10/1981 | (SU) . | |
| 997975 | | 2/1983 | (SU) . | |
| 1320016 | * | 6/1987 | (SU) | 164/132 |

OTHER PUBLICATIONS

Das Reingen von Druckgub in Wäbrigen Lösungenals Altermativr zur Reingung mit Lösemittein H. D. Heidenblutt, Glesserei 75, pp. 110–113, 1988.
Hochdruck–Nabentkernungs maschine für Glesserei 73, pp. 515–516, 1986.

* cited by examiner

*Primary Examiner*—Joseph J. Hail, III
*Assistant Examiner*—I.-H. Lin

(57) ABSTRACT

Method for removing a ceramic core from a casting in a relatively rapid manner wherein the casting and a fluid spray nozzle are disposed in a manner to expose a region of the core to a core dissolving fluid discharge of the nozzle and a core dissolving fluid is discharged from the nozzle toward the core region to contact the core region and dissolve core material therefrom and progressively from further regions of the core within the casting as they become exposed as core material is progressively removed. The discharge of fluid from the nozzle can be interrupted periodically to allow dissolved core material and fluid to drain from inside the casting or, alternately, the casting and nozzle can be relatively moved so that the casting can drain and/or forced air can be directed at the casting to this same end at a location spaced apart form the nozzle.

20 Claims, 12 Drawing Sheets

METHOD FOR REMOVING CORES FROM CASTINGS

FIELD OF THE INVENTION

The present invention relates to the removal of a core, such as a ceramic core, from inside of a casting, such as an investment casting.

BACKGROUND OF THE INVENTION

In the manufacture of gas turbine engine components, such as gas turbine engine blades and vanes, an appropriate alloy, such as a nickel or cobalt based superalloy, is investment cast in a ceramic investment mold. One or more ceramic cores may be present in the ceramic investment mold in the event the cast component is to include one or more internal passages. For example, gas turbine blades and vanes for modern, high performance gas turbine engines typically include internal cooling passages extending through the airfoil and root portions and through which passages compressor bleed air is conducted to cool the airfoil portion during engine operation. In this event, the ceramic core positioned in the investment mold will have a configuration corresponding to the internal cooling passage (s) to be formed through the airfoil and root portions of the cast turbine blade or vane. The blade or vane component may be cast by well known techniques to have an equiaxed, columnar, or single crystal microstructure.

In the past, the ceramic core has been removed from the investment cast component by an autoclave technique or an open kettle technique. One autoclave technique involves immersing the cast component in an aqueous caustic solution (e.g. 45% KOH) at elevated pressure and temperature (e.g. 250 psi and 177° C.) for an appropriate time (e.g. 4–10 hour cycles) to dissolve the core from the casting. U.S. Pat. Nos. 4,134,777 and 4,141,781 disclose autoclave caustic leaching of yttria ceramic cores and beta alumina ceramic cores from directionally solidified superalloy castings. An exemplary open kettle technique involves immersing the cast component in a similar aqueous caustic solution at ambient pressure and elevated temperature (e.g. 132° C.) with agitation of the solution for a time (e.g. 90 hours) to dissolve the core from the casting. These core removal techniques are quite slow and time-consuming.

SUMMARY OF THE INVENTION

The present invention provides method and apparatus for removing a core from inside a casting in a relatively rapid manner as compared to the aforementioned autoclave and open kettle techniques. One embodiment of the method comprises disposing the casting and a fluid spray means, such as for example only a fluid spray nozzle, in a manner to expose a region of the core to a core dissolving fluid discharge of the fluid spray means, supplying a core dissolving fluid to the fluid spray means for discharge toward the exposed core region, and discharging the fluid from the fluid spray means to contact the core region and remove core material therefrom and progressively from further regions of the core within the casting as they become exposed as core material is progressively removed.

The discharge of fluid from the fluid spray means can be interrupted periodically to allow dissolved core material and spent fluid to drain from inside the casting or, alternately, the casting and fluid spray means can be relatively moved so that the casting can drain to this same end at a drain location apart from the fluid spray means. In a particular embodiment of the invention, the casting and a plurality of fluid spray nozzles are relatively moved so that the casting is moved from one fluid spray nozzle to the next to receive core dissolving fluid at each nozzle and to drain dissolved core material and spent fluid when moved to a drain location between the nozzles. A plurality of castings can be carried on a linearly movable carrier, such as a transport conveyor, or on a rotatable carrier, such as a carousel, past a plurality of fixed or stationary core dissolving fluid spray nozzles to remove the core from each casting.

In practicing the invention to remove a ceramic core from turbine blade or vane investment castings having an airfoil portion and root portion with the core exposed at the root portion, the castings and one or more core dissolving fluid spray means, such as fluid spray nozzles, are positioned so that a caustic solution (e.g. 45% KOH) at elevated temperature (e.g. 100 to 150° C.) and pressure (e.g. 50 to 450 psi) is supplied to the nozzles and discharged at the exposed core region at the root portion to dissolve the core from the root portion progressively through the airfoil portion in a relatively short time (e.g. typically 1 to about 10 hours) depending upon the configuration of the casting and core therein. One or more additional core dissolving fluid spray nozzles may be positioned to discharge core dissolving fluid at the blade or vane casting tips where another region of the core may be exposed at a tip plenum cavity of the castings.

The invention will be described in more detail by the following drawings and detailed description.

DETAILED DESCRIPTION OF THE INVENTION

Figure 1:
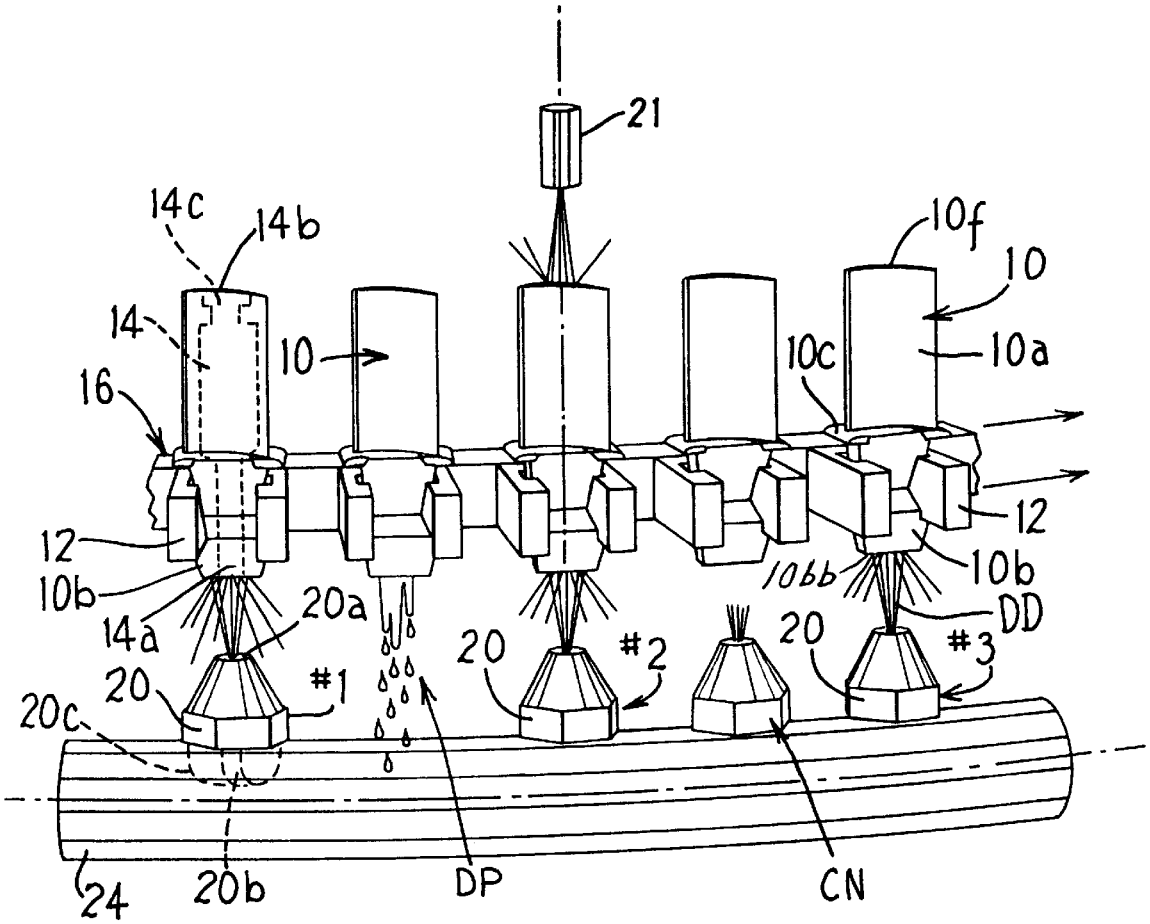
FIG. 1 is a schematic perspective illustration of one embodiment of the invention for removing a ceramic core from inside each of a plurality of cast turbine blades.

One embodiment of the present invention to remove a ceramic core from a plurality of turbine blade investment castings 10 is schematically illustrated in FIG. 1. In particular, a plurality of cored turbine blade investment castings 10 are shown fixtured vertically in fixtures 12 on an annular fixture ring 16 that is rotated about a vertical axis by a variable speed rotor or other ring rotating motor (not shown). The turbine blade castings 10 can comprise equiaxed, columnar, or single crystal nickel base or cobalt base superalloy castings made by well known conventional investment or other casting processes. Although FIG. 1 illustrates turbine blade investment castings 10, this is only for purposes of illustration and not limitation. The invention is not limited to any particular casting technique or to any particular casting shape, casting metal, alloy or other material, or casting microstructure and can be practiced to remove a core from a wide variety of casting shapes, microstructures, and cast compositions produced by different casting processes.

Figure 2:
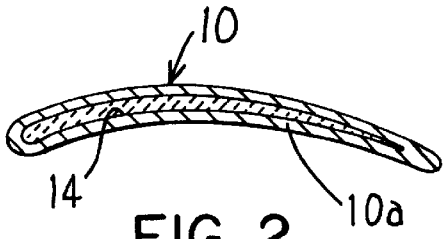
FIG. 2 is a cross sectional view of an airfoil of a turbine blade casting.

The turbine blade castings 10 include an airfoil portion 10*a*, a root portion 10*b*, a platform portion 10*c* between the root and airfoil portions, and a tip portion 10*f* in conventional manner. Residing within each turbine blade casting 10 is a ceramic core 14 that is embedded in the casting by virtue of being present in the ceramic or other casting mold (not shown) and having alloy, metal or other melt material cast thereabout. The ceramic core 14 is configured to form an internal cooling air passage in the turbine airfoil and root portions 10*a* and 10*b*. The ceramic core 14 extends to the bottom of the root portion 10*b* where it is exposed or opens at core region 14*a* to an external root end surface 10*bb*, FIG. 2, to communicate to the outside or ambient. The ceramic core also may be exposed at the tip 10*f* of the casting 10 at core region 14*b* externally to the outside to form a tip plenum cavity region 14*c* also for air cooling purposes.

The ceramic core 14 typically comprises an appropriate ceramic material selected in dependence on the metal, alloy or other material to be cast thereabout in the casting mold. For nickel base superalloys, such as Rene' 125, used in the manufacture of cast turbine blades and vanes as well as vane segments, the core 14 can comprise silica, zirconia, and alumina. For cobalt base superalloys, such as MAR-M509, also used in the manufacture of cast turbine blades and vanes as well as vane segments, the core 14 can comprise silica, zirconia, and alumina. Cores of different composition can be used depending on the particular metal, alloy or other material being cast and can be selected accordingly. The invention, however, is not limited to any particular core material and can be practiced to remove a core that is internal of a casting and is dissolvable in a suitable core dissolving fluid, such as, for example only, an aqueous caustic solution.

As shown in FIG. 1, the root portion 10*b* of each turbine blade casting 10 is received and held in a respective fixture or clamp 12 during core removal. The castings 10 are vertically located or oriented by the fixtures 12 with the root portions 10*b* lowermost and proximate core dissolving fluid spray means such as fluid spray nozzles 20. Thus, the turbine blade castings 10 are fixtured in a manner to communicate a lowermost core region 14*a* exposed at the root end surface 10*bb* to a core dissolving fluid stream discharge DD of each fluid spray nozzle 20.

In FIG. 1, the fluid spray nozzles 20 are spaced apart in a circular array that is beneath and aligned with the path of movement of the castings 10 so that the exposed core regions 14*a* pass over and communicate with the discharge ends 20*a* of the fluid spray nozzles 20 as they are moved by the fixture ring 16. Between the fluid spray nozzles 20 are defined drain positions DP where dissolved core material and spent core dissolving fluid residing in passage regions formed in the castings 10 by removal of core regions can drain by gravity and/or by forced (compressed) air (e.g. 90 psi compressed air or other gas) directed upwardly in FIG. 1 at the castings 10 by underlying compressed air discharge nozzles CN (one shown) positioned in alternating sequence between the spray nozzles 20 to this end. The castings 10 typically are moved in stepped or intermittent manner so as to reside at each fluid spray nozzle 20 and drain position DP a selected period of time to this end. Alternately, the castings 10 typically can be moved at a constant speed relative to the spray nozzles 20 and drain positions DP and/or compressed air nozzles CN with the speed adjusted to be slow enough for adequate fluid removal from internal of the castings 10 by gravity drainage and/or as forced by compressed air.

The fluid spray nozzles 20 are disposed on a stationary annular, tubular fluid manifold 24 (partially shown) that receives core dissolving fluid at elevated temperature and pressure from high pressure pumps to be described herebelow. The manifold 24 and thus the fluid spray nozzles 20 are disposed in fixed relation or position relative to the rotatable fixture ring 16, although the invention is not so limited and can be practiced with the fluid spray nozzles 20 movable relative to the stationary castings 10, or with both the fluid spray nozzles 20 and castings 10 movable. Still further, in another embodiment of the invention described herebelow, the fluid spray nozzles 20 and the castings 10 are not moved relative to one another. Such embodiment is useful, although not limited, for removing ceramic core material from large industrial gas turbine engine vanes and blades.

The fluid manifold 24 includes a plurality of spaced apart apertures that receive a respective fluid spray nozzle 20 by, for example, threading of the nozzle body in each manifold aperture. The fluid spray nozzles 20 include a passage 20*b* that receives the core dissolving fluid from the manifold 24 at the inner nozzle end 20*c* and directs the core dissolving fluid to the outer nozzle discharge end 20*a* toward the exposed core region 14*a* that is located in registry and in communication with the nozzle discharge end 20*a* therebelow. The fluid spray nozzles 20 are sized to provide a selected core dissolving fluid flow rate (gallons per minute) at a given fluid pressure toward the core region 14*a* registered therewith. The spray nozzles 20 shown are available under designation Washjet solid stream 0° (zero degree) nozzles from Spraying Systems Co., North Ave., Wheaton, Ill. 60188.

Although the discharge ends 20*a* of the fluid spray nozzles 20 are shown spaced from the exposed core region 14*a*, they can be spaced closely to the root end surface 10*bb* provided clearance is present for relative movement of the nozzles 20 and castings 10 and depending on the relative spray size of the nozzles 20 and the area of the exposed core region 14*a*.

The core dissolving fluid is selected so as to be capable of dissolving the ceramic material of the core 14 residing in the castings 10. For the ceramic cores described hereabove used in the manufacture of nickel based and cobalt based superalloy castings, a suitable core dissolving fluid comprises an aqueous caustic solution at elevated temperature and pressure. For example, an aqueous caustic solution comprising from 35% to 50% by weight KOH or higher can be used at a temperature between 220 and 280° C. or higher and pressure of 50 to 450 psi and higher depending on pump capability available. Alternately, an aqueous caustic solution comprising 27 to 50% by weight NaOH and higher at the temperatures and pressures just described can be used as the core dissolving fluid. These core dissolving fluids are offered for purposes of illustration only, the invention not being limited to these core dissolving fluids. The invention can be practiced with other fluids that are capable of dissolving a particular core material involved in the manufacture of a particular casting.

In practicing a method embodiment of the invention, the fixture ring 16 is intermittently rotated to move each casting 10 sequentially past the first (#1), second (#2), third (#3), etc. fluid spray nozzles 20 arranged in series and the intervening drain positions DP to remove core material at the exposed core region 14*a* at the root portion 10*b* and progressively from further regions of the core within the airfoil portion 10*a* of the castings 10 as they become exposed as core material is progressively removed. The elevated temperature and pressure core dissolving fluid discharged from the fluid spray nozzles 20 is effective to dissolve and mechanically flush core material from the core regions until eventually most or all of the core 14 is removed from each casting 10. The core dissolving fluid can be continuously discharged from the nozzles 20 or can be discharged periodically as a casting 10 is positioned thereabove. The number of fluid spray nozzles 20 employed and the temperature and pressure of the core dissolving fluid, flow rate and concentration of core dissolving fluid, as well as the residence time of the castings above each nozzle 20 (i.e. speed of transport of castings via fixture ring 16) are selected accordingly.

Another embodiment of the invention similar to that described hereabove can be practiced with as few as one (1) fluid spray nozzle 20 wherein each casting 10 is positioned above the single nozzle 20 for a time as needed to remove the core 14 therefrom. Additional nozzles 20 can be used with each casting 10 residing at the a respective nozzle 20 for the entire time needed for core removal; i.e. there is no relative movement between each nozzle 20 and the associated casting 10 therewith for core removal. In this embodiment, the discharge of core dissolving fluid from each nozzle 20 is interrupted periodically to allow dissolved core material and spent fluid to drain from inside the casting 10 while it is positioned above the respective nozzle 20. Otherwise, removal of the core 14 from the casting 10 is effected in similar manner.

For purposes of illustration rather than limitation, the invention can be practiced to remove a silica based ceramic core from a conventional turbine blade investment casting (first stage blade for V2500 gas turbine engine made by Pratt & Whitney Aircraft) having an airfoil portion and root portion with the core exposed at the root portion. Core dissolving fluids used were 35%, 40%, 45%, and 50% by weight KOH and 50% NaOH aqueous solutions. The caustic solution was supplied to a single fluid spray nozzle (Washjet solid stream 0° nozzle from Spraying Systems Co.) as described hereabove with respect to the alternative embodiment where each casting is positioned above the nozzle without movement for the entire time to remove the core therefrom. The caustic solution was supplied at different temperatures in the range of 220 to 280° C. and a manifold pressure of 400 psi to provide a solution flow rate of 19 gallons per minute through the nozzle. The flow of caustic solution to the nozzle was interrupted every 0.17 minutes for 0.17 minute intervals to allow drainage of dissolved core material and spent caustic solution from the casting. The time required to remove the cores from the castings ranged from 1 to 10 hours. Core removal in 4 hours was achieved at 121° C. and 400 psi using an aqueous caustic solution comprising 45% by weight KOH.

One or more additional core dissolving fluid spray nozzles 21 may be positioned as shown in FIG. 1 for discharging core dissolving fluid at the casting tips 10*f* where another region 14*b* of the core may be exposed at a tip plenum cavity 14*c* of the castings 10.

Referring to FIGS. 3–9, one embodiment of apparatus for practicing the invention for removing a ceramic core from each of a plurality of turbine blade castings is illustrated wherein a plurality of turbine blade castings 10 are fixtured and carried on a rotatable carrier, such as a rotary carousel 125, past a plurality of stationary core dissolving fluid spray nozzles 120. The core dissolving fluid spray nozzles 120 are disposed on a stationary central fluid manifold 124 located at the rotational axis of the carousel 125.

The rotary carousel 125 is rotatably mounted in a stainless steel cabinet 126 (schematically shown) having a hinged access door 127 openable to permit the castings 10 to be fixtured on the carousel. The cabinet 126 is supported on a structural member support base B. The door 127 includes hinges 127*a* and handles 127*b*.

Figure 4:
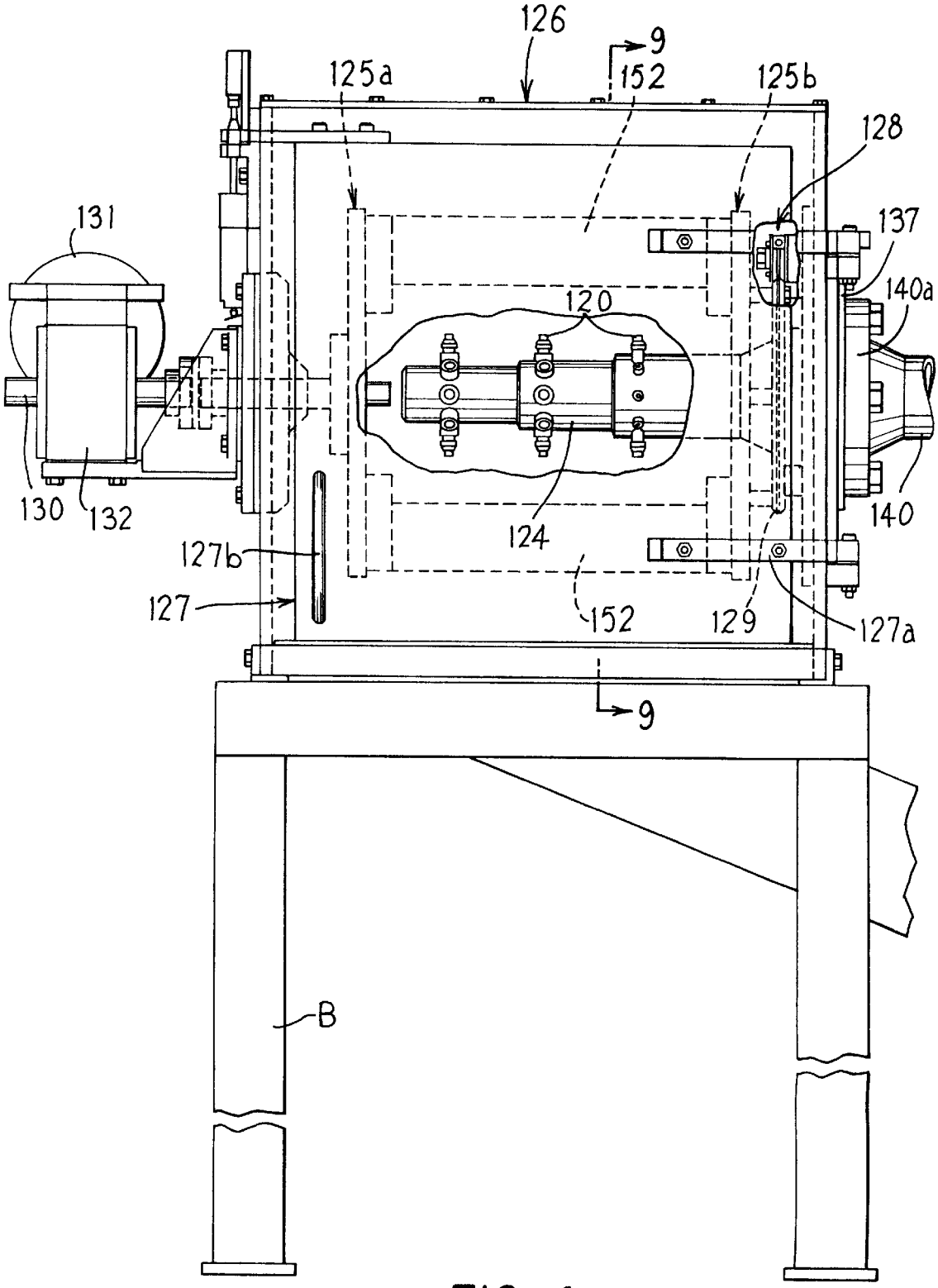
FIG. 4 is a more detailed side elevation of apparatus of one embodiment of the invention with the cabinet partially broken away to reveal the spray manifold and a portion of the casting rotary carousel.
Figure 5:
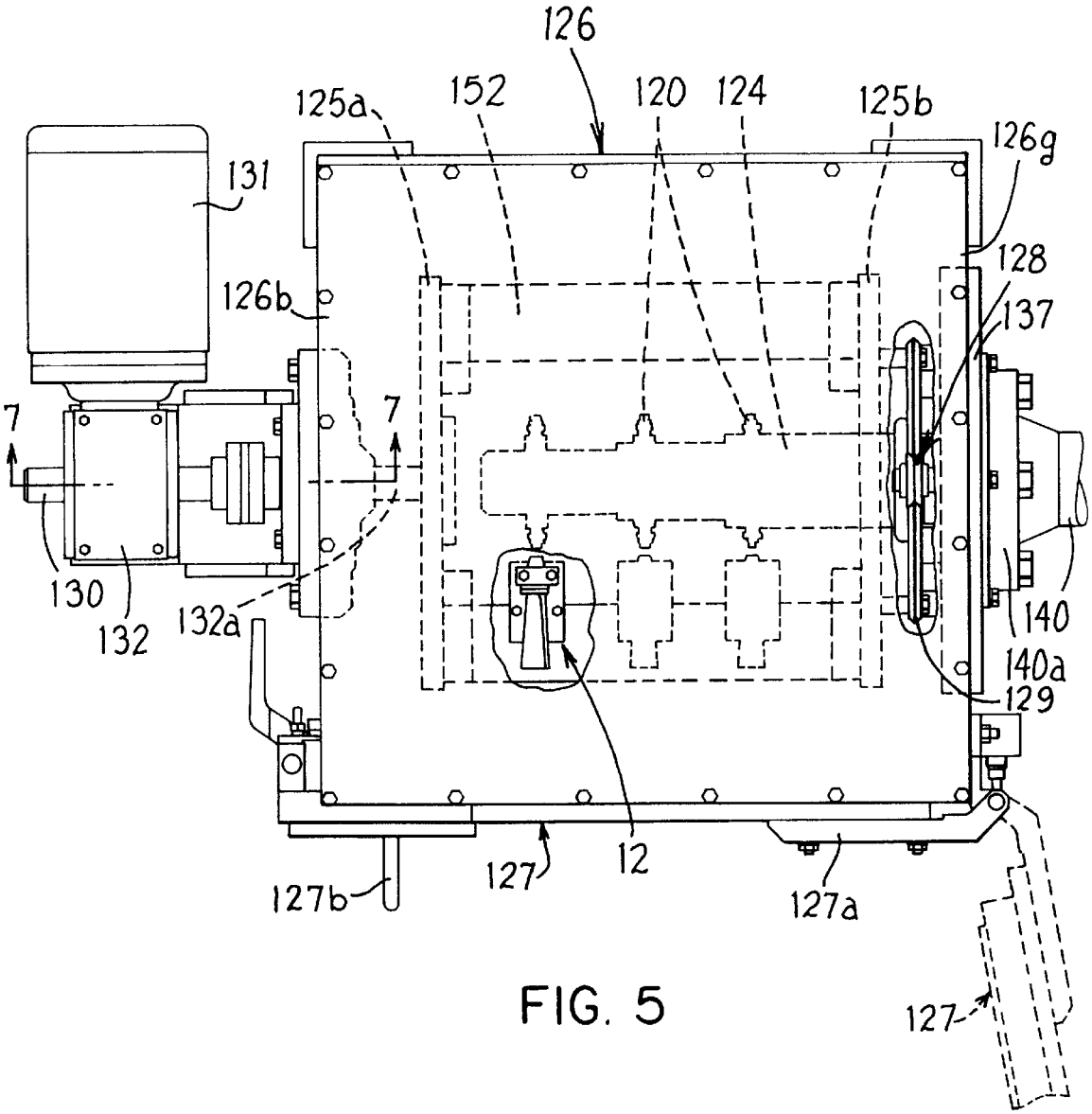
FIG. 5 is a plan view of the apparatus of FIG. 3 with the cabinet partially broken away to reveal the rotary carousel drive and turbine blade casting.
Figure 6:
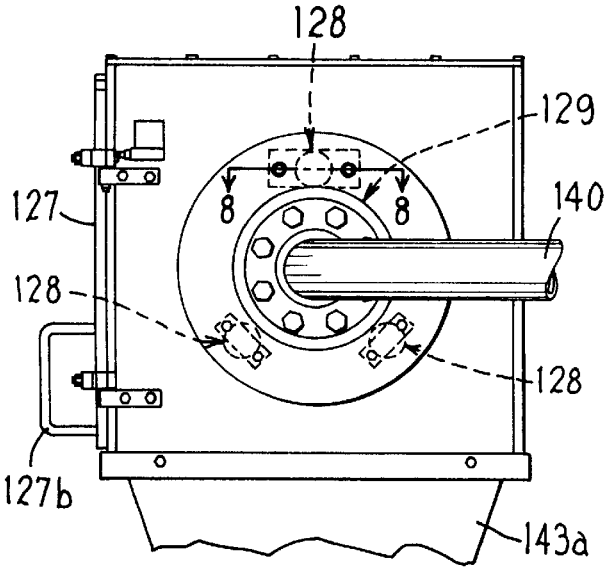
FIG. 6 is a side elevation of the cabinet.

The carousel 125 is supported at a free end by a plurality (3 shown) of wheel assemblies 128 engaging a carrier ring 129 as shown best in FIGS. 4, 5, and 6. The wheel assemblies 128 each include a rotatable wheel 128*a* having a concave V-shaped profile (FIG. 8) for riding on a convex V-shaped periphery of the carrier ring 129. The wheel assemblies 128 are mounted on cabinet 126. The carrier ring 129 is mounted (bolted) on the carousel 125. The rotary carousel 125 is thereby rotatably supported in the cabinet 126 at one end by the wheel assemblies 128 and carrier ring 129 and at the other end by the carousel drive arrangement described in the next paragraph.

Figure 7:
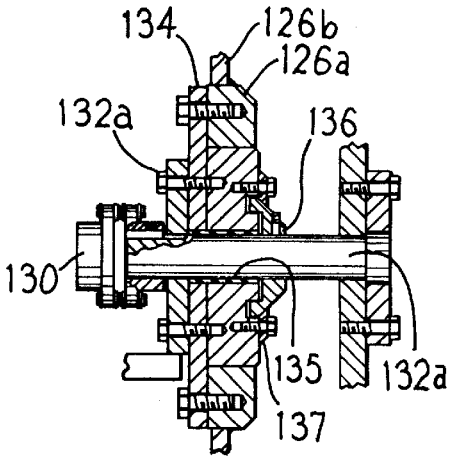
FIG. 7 is a partial sectional view along lines 7—7 of FIG. 5.
Figure 8:
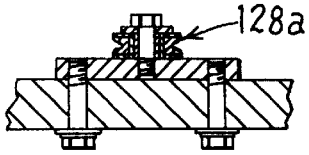
FIG. 8 is a partial sectional view along lines 8—8 of FIG. 6.

The rotary carousel 125 is rotated by a drive shaft 130 that is coupled to an electric or other suitable drive motor 131 by a gear reducer 132. The shaft 130 is coupled to a drive spindle 132*a*, FIGS. 4–5 and 7, that extends through a hub 126*a* of the cabinet wall 126*b* and through a gear reducer mounting plate 132*a*, pass-through plate 134 on the cabinet wall hub 126*a*, and through a fluoropolymer flange bearing 135. The flange bearing 135 is sealed on the inside of the cabinet 126 by a shaft baffle ring 136 held on the shaft by the set screw shown and a baffle ring 137 fastened (bolted) to the cabinet wall hub 126*a* as shown in FIG. 7. Rotation of the shaft 130 by the drive motor 131 through the gear reducer 132 is thereby transmitted to the drive spindle 132*a* and the carousel 125 on which the castings 10 are fixtured.

Figure 4A:
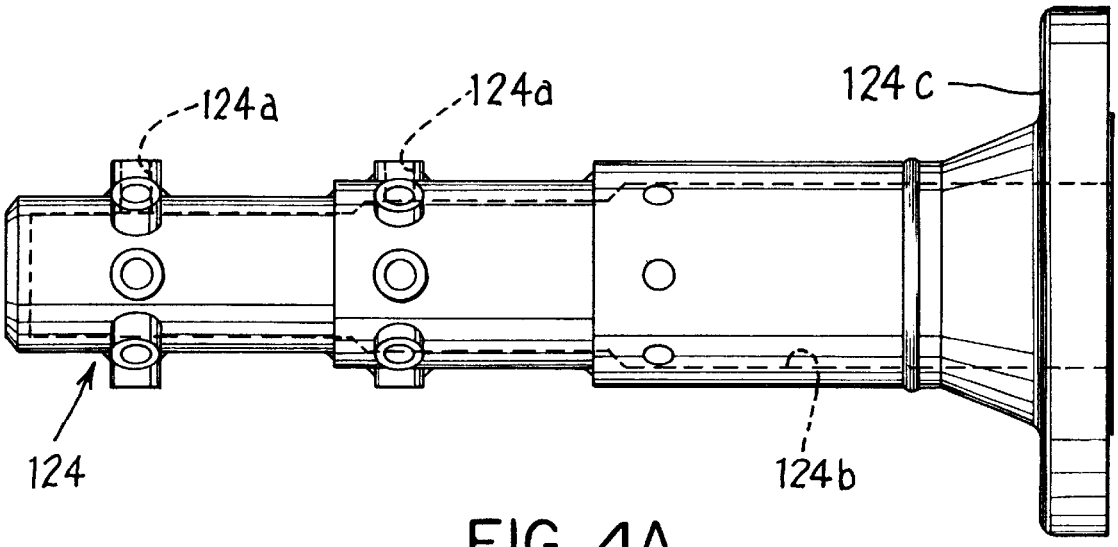
FIG. 4A is an elevational view of the spray manifold.
Figure 4B:
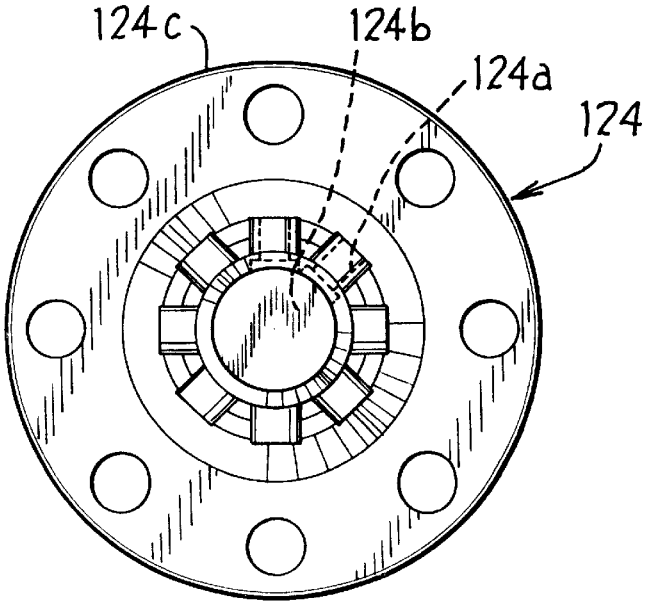
FIG. 4B is an end elevation of the spray manifold of FIG. 4A.

The drive shaft 130 and drive spindle 132 are coaxially aligned with the fluid manifold 124 shown best in FIGS. 4A, 4B as having a plurality of threaded apertures 124*a* in an annular array at spaced apart axial locations along the manifold to threadably receive the core dissolving fluid spray nozzles 120 of the type described hereabove (0 degree spray nozzles). The manifold 124 includes a central passage 124*b* for receiving the pressurized, hot caustic fluid from the pumps P1, P2. The fluid flows through the passage 124*b* and then through spray nozzles 120 threaded into the apertures 124*a* for discharge toward the castings 10 in the manner described hereabove.

The fluid manifold 124 is mounted (bolted) via a manifold flange 124*c* on a manifold pass-through plate 137 fastened (bloted) on the cabinet wall 126*g* opposite to the cabinet wall 126*b*. A flange 140*a* of a caustic feed conduit or pipe 140 is bolted to the pass-through plate 137 to communicate the manifold passage 124*b* and the feed pipe 140 conveying the pressurized, hot caustic fluid from the pumps P1, P2.

The pump P1 comprises a relatively low pressure feed pump (e.g. 75 psi), while the pump P2 comprises a high pressure pump (e.g. 400 psi) for pumping via the feed pump P1 hot caustic fluid from the heated sump 143 of the cabinet 126 via a suction pipe 144. The suction pipe is communciated to an inlet box disposed at the bottom of the sump 143. The sump 143 receives caustic solution from the cabinet via a return trough 143*a* therebetween. The pump arrangement is similar to that shown in FIG. 14 for another embodiment of the invention. The inlet box 145 includes an upper filter screen (not shown) for preventing ceramic debris of a certain size from being sucked through the suction pipe 144. A filter screen size of 60 mesh providing an 0.0092 inch by 0.0092 inch square opening can be used to this end.

A serpentine heat exchanger 150 (see FIG. 14) is disposed in the sump 143 and is heated by a gas-fired burner (not shown) disposed proximate the sump 143 such that burner gases flow through the serpentine heat exchanger. The serpentine heat exchanger 150 is submerged in the caustic fluid and heats the caustic fluid (e.g. 45% by weight KOH) to elevated temperature, such as about 100 to about 150 degrees C. Make-up caustic solution is supplied to the sump 143 by a valve and make-up fluid tank (not shown) to counter losses by evaporation. The level of the caustic fluid in the sump 143 is sensed by a float or other similar device and provides a signal to add make-up caustic fluid when the fluid level in the sump 143 drops below a predetermined level.

Figure 3:
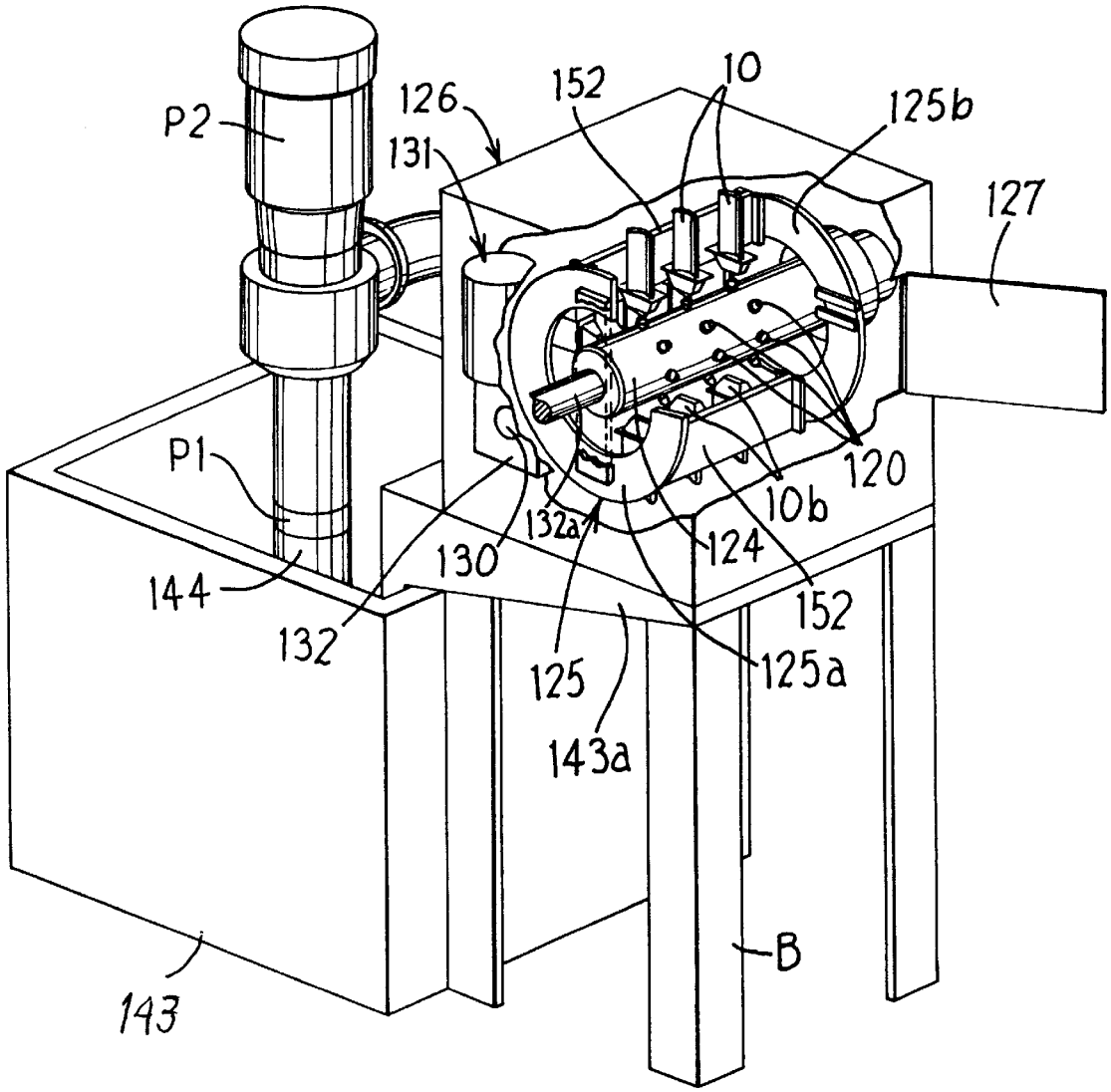
FIG. 3 is a schematic perspective view of one embodiment of apparatus for practicing the invention for removing a ceramic core from each of a plurality of turbine blade castings.

The rotary carousel 125 includes opposite end plates 125*a*, 125*b* joined together by fixture tie bars 152 bolted or otherwise fastened to the end plates 125*a*, 125*b* at circumferentially spaced apart intervals. Only some of the tie bars 152 are shown in FIGS. 3 4, and 5 for convenience. Each tie bar 152 supports a load bar 154 bolted or otherwise fastened thereto. Each load bar 154 in turn has fastened thereto by mounting plates 156 clamping fixtures F that engage and hold the root portion of the turbine blade castings 10, FIGS. 11–12.

Figure 9:
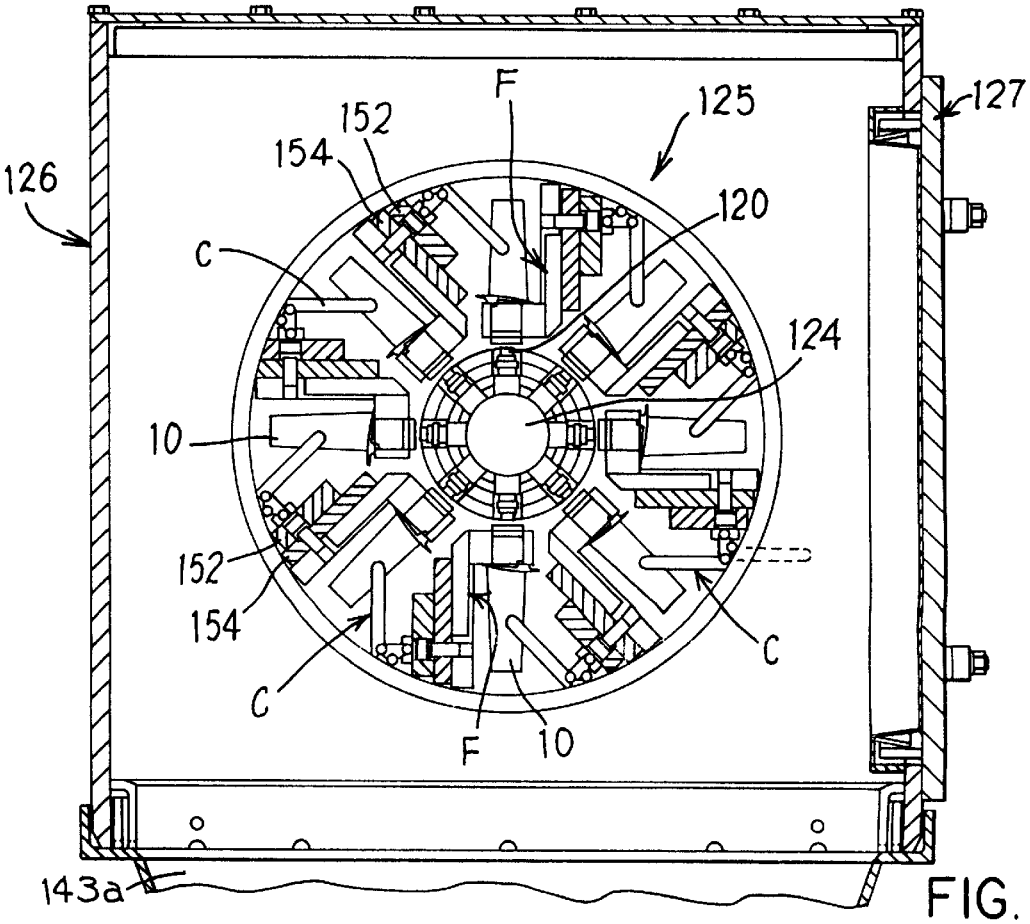
FIG. 9 is partial sectional view along lines 9—9 of FIG. 4.

In FIG. 9, straight-line action toggle clamps C are shown for holding the load bar 154 to the carousel bar 152. The clamping fixtures F are bolted to the load bar 154, FIG. 11. The clamping fixtures F are shown in detail in FIGS. 10–12 as comprising a pair of mounting blocks 156 by which the fixture is fastened (bolted) to a respective load bar 154. The mounting blocks 156 are in turn fastened (bolted) to a lower stainless steel fixture bar 162 to which is screwed a Teflon or other resilient pad 164 thereon to avoid localized grain recrystallization when single crystal (SC) and/or columnar grain directionally solidified (DS) castings are heat treated. An upper stainless steel fixture bar 166 carrying a Teflon or other resilient pad 168 is mounted on the lower fixture bar 162 by a pair of threaded rods 170 and nuts 172. Fixtures for use in treating equiaxed castings wherein grain recrystallization is not a concern can be made of all stainless steel.

Figure 10:
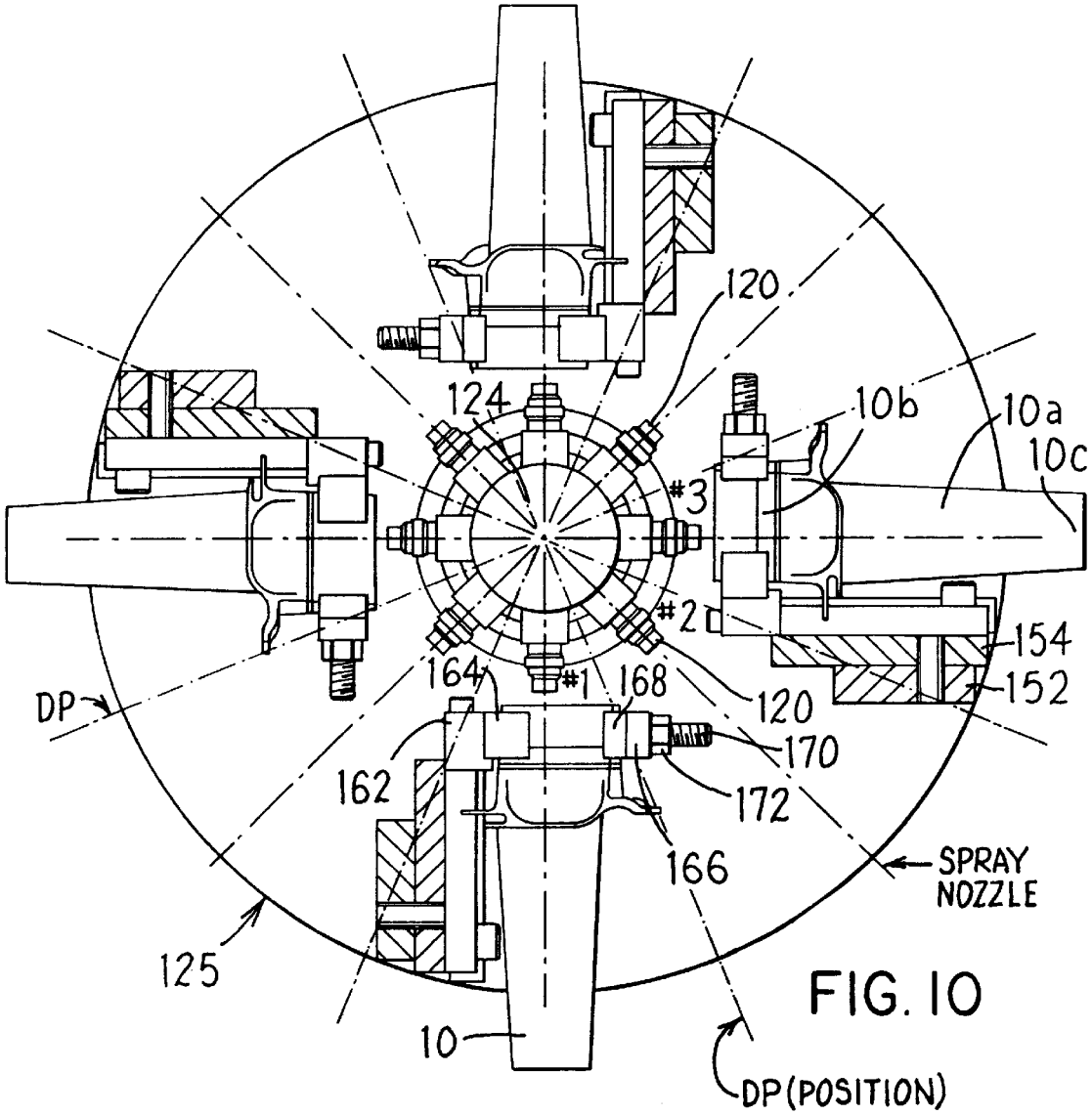
FIG. 10 is a similar sectional view of another embodiment of the invention for fixturing a particular turbine blade on the rotary carousel for core removal.

The Teflon pads 164, 168 for SC/DS castings 10 are brought into clamping engagement with the root portions of the castings 10 by lowering the upper fixture bar 166 on the threaded rods 170 and tightening the nuts 172 as shown best in FIG. 10. The pads 164, 168 which are configured complementary to the root profile to this end as shown in FIG. 10 to engage the root portions 10*b* of the castings 10 (e.g. 3 castings in FIGS. 11–12).

Figure 11:
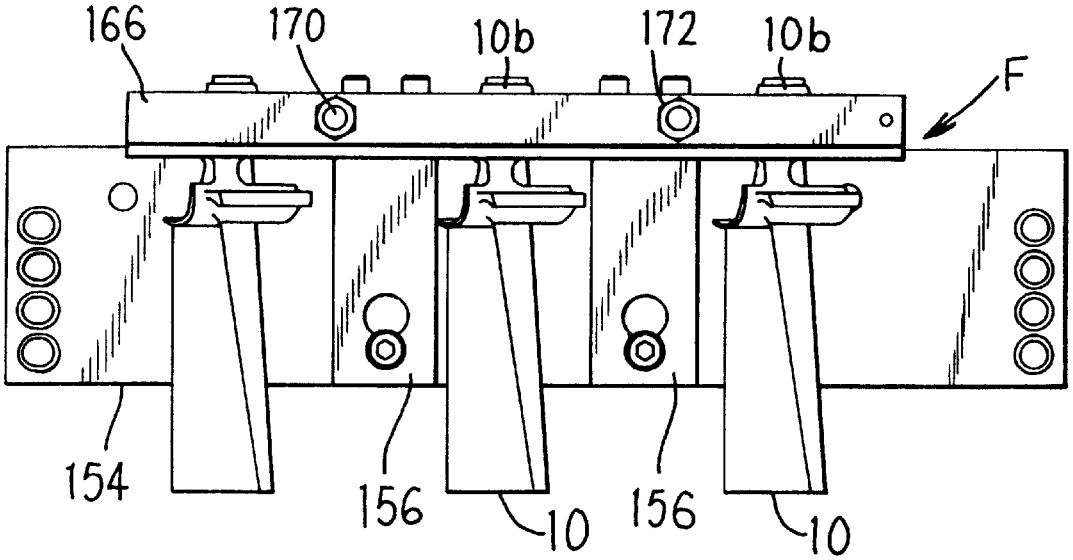
FIG. 11 is an elevational view of a load bar of FIG. 10 with turbine blades fixtured thereon.
Figure 12:
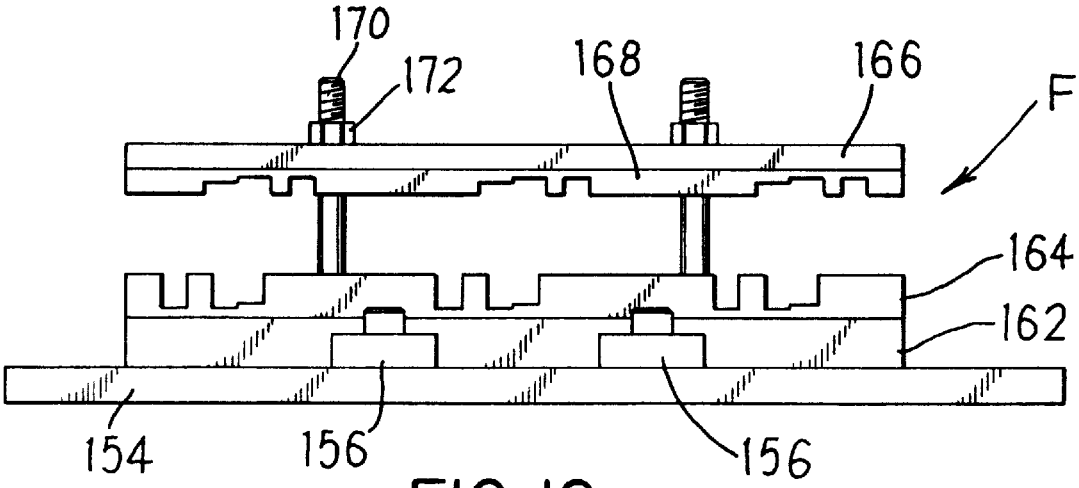
FIG. 12 is an elevational view of a blade fixture of FIG. 11 with the fixture open.
Figure 13:
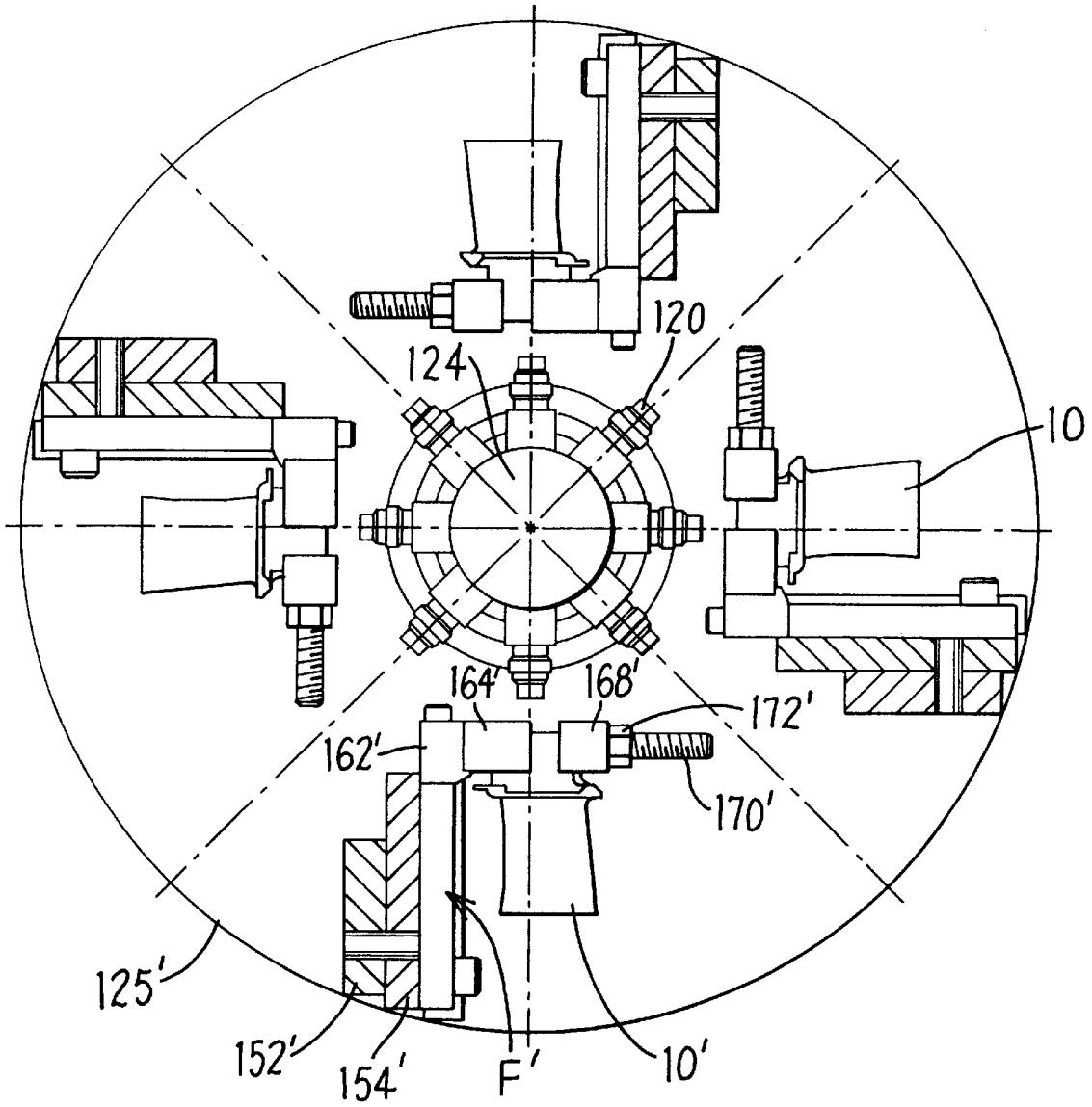
FIG. 13 is a sectional view similar to FIG. 10 for fixturing a different turbine blade on the rotary carousel for core removal.

Referring to FIG. 13, fixturing for clamping different equiaxed turbine blade castings 10' (i.e. differently shaped castings) is shown for illustration. In these like features of FIGS. 10–12 are represented by like reference numerals primed. In the fixture F shown in FIG. 13, the upper fixture bar 166 of FIGS. 11–12 is omitted since the castings 10 are equiaxed grain castings.

In practicing another method embodiment of the invention, the rotary carousel 125 is intermittently rotated by drive motor 131 to move the castings 10 sequentially past the first (#1), second (#2), third (#3), etc. fluid spray nozzles 120 arranged in circumferential arrays on the fluid manifold 124, FIG. 10, and intervening drain positions DP and/or compressed air blow off positions where compressed air nozzles (not shown) are disposed to remove core material at the exposed core region at the root portion 10*b* and progressively from further regions of the core within the airfoil portion 10*a* of the castings 10 as they become exposed as core material is progressively removed. The elevated temperature and pressure core dissolving fluid discharged from the fluid spray nozzles 120 is effective to dissolve and mechanically flush core material from the core regions until eventually most or all of the core 14 is removed from each casting 10. The core dissolving fluid can be continuously discharged from the nozzles 20 or can be discharged periodically as a casting 10 is positioned in registry therewith. The number of fluid spray nozzles 120 employed and the temperature and pressure of the core dissolving fluid, flow rate and concentration of core dissolving fluid, as well as the residence time of the castings with each nozzle 120 (i.e. speed of transport of castings via the carousel 125) are selected accordingly.

Figure 14:
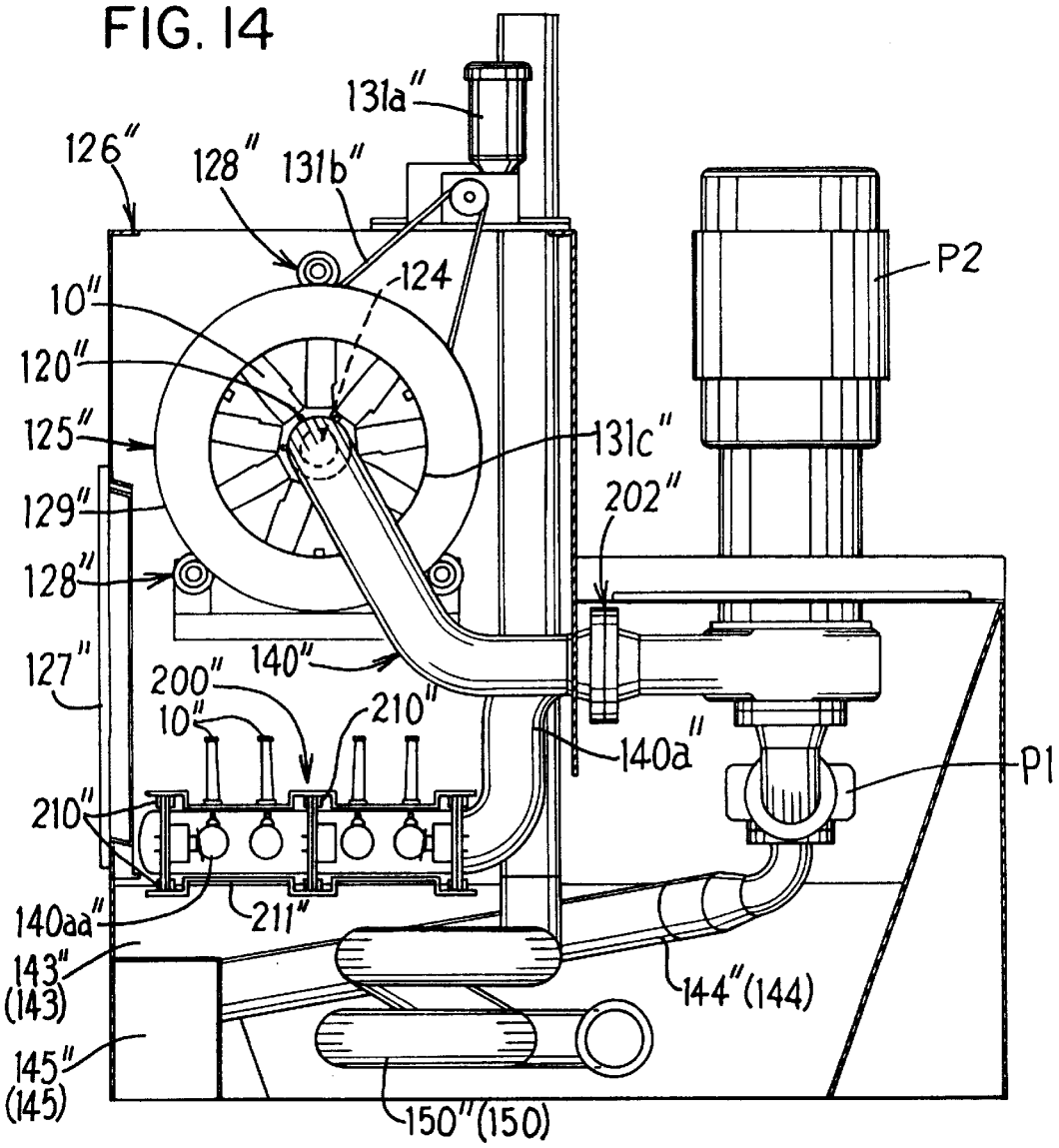
FIG. 14 is a schematic sectional view of the cabinet of another embodiment of apparatus of the invention for removing a core from a plurality of turbine blade castings fixtured on either a rotary carousel or a linear conveyor.
Figure 15:
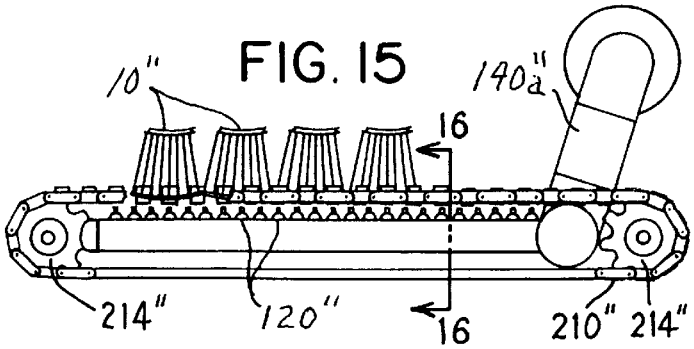
FIG. 15 is an elevational view of the linear conveyor of FIG. 14.
Figure 16:
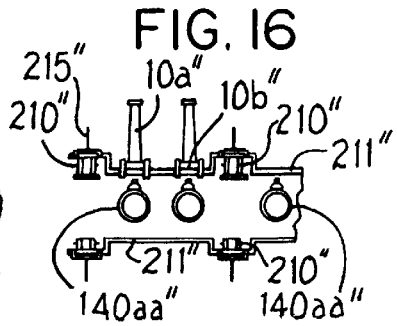
FIG. 16 is a view along lines 16—16 of FIG. 15.

Referring to FIGS. 14–16, apparatus in accordance with another embodiment of the invention is shown in schematic manner. The apparatus includes a rotary carousel 125" like that described hereabove in detail with respect to FIGS. 3–15 wherein like features are represented by like reference numeral double primed. The carousel 125" is shown optionally rotated by a drive motor 131*a"* via a drive chain 131*b"* about a pulley 131*c"* fastened to the carousel 125". This optional carousel drive is illustrated schematically to simply show an alternative carousel drive mechanism.

The apparatus also includes a linear conveyor 200" disposed in the cabinet 126" below the carousel 125". A valve 202" controls flow of pressurized, hot fluid from the sump 143" through either the feed pipe 140" to the fluid manifold 124*a"* of the carousel 125" or to the fluid manifold 140*a"* of the linear conveyor 200".

The linear conveyor 200" comprises endless conveyor chains 210" that convey fixture bars 211" in a linear motion manner. The fixture bars 211" hold cored vane segment castings 10" and transport them past a plurality of core dissolving fluid spray nozzles 120" arranged in linear array as the chains are driven by sprockets 214". The direction of movement of the conveyor and the castings 10" thereon is parallel with the linear array of nozzles 120". The fixture bars 211" are retained in position by retainers 215" that are fastened on conveyor 200'. The nozzles 120" are communicated to a respective fluid branch manifolds 140*aa"* extending from main manifold 140*a"*. The vane segment castings 10" are fixtured on the fixture bars 211" so that exposed core regions at the lower portion 10*b"* are removed by the discharge of fluid from the nozzles 120" in the manner described hereabove and progressively from further regions of the core within the airfoil portion 10*a"* of the castings 10" as they become exposed as core material is progressively removed. A ceramic debris collector conveyor (not shown) may be disposed beneath the linear conveyor to collect and discharge and solid ceramic debris that may fall from the castings.

Figure 17:
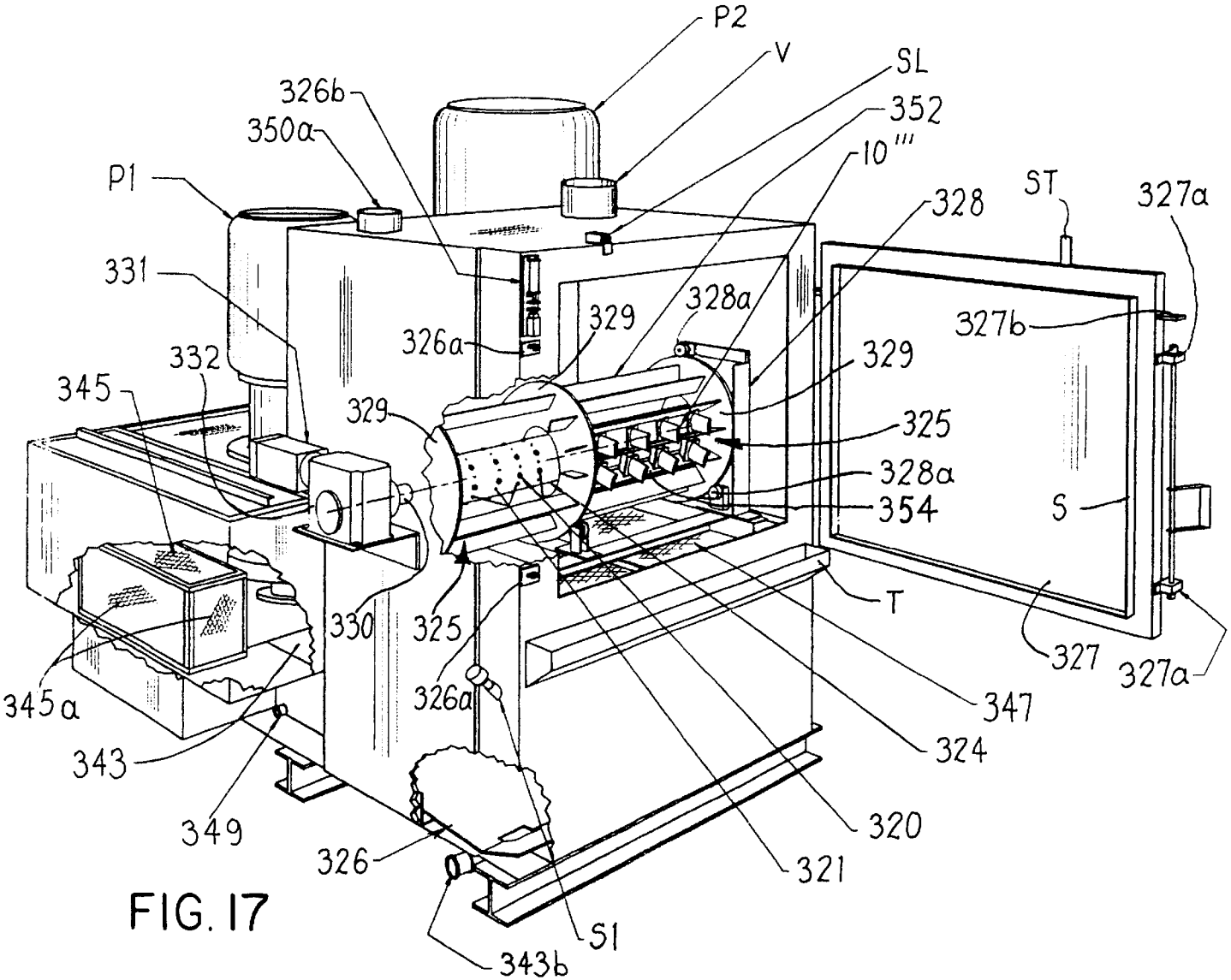
FIG. 17 is a perspective view of another embodiment of apparatus of the invention.

Referring to FIG. 17, apparatus in accordance with still another embodiment of the invention is shown. A cleaning cabinet 326 includes a hinged access door 327 that is openable via the handle shown to permit castings 10'" fixtured on load bars 354 to be mounted on tie bars 352 in a manner described hereabove with respect to previous figures of a rotary carousel 325. The carousel 325 includes two carousel sections disposed in end-to-end relation in the internal chamber defined by the cabinet and closed door about a stationary, constant diameter fluid manifold 324. The rotary carousel 325 is otherwise similar to those described hereabove with respect to previous figures. The door 327 includes latches 327*a* that cooperate with latches plates 326*a* of the cabinet for door closing. A door locking plate 327*b* cooperates with cabinet locking device 326*b* to lock the door and prevent door opening during the core removal operation. The door includes a seal S to seal on the cabinet when the door is closed and locked. A limit switch SL is used with a switch trip ST on the door to detect door closure in order to proceed with the core removal operation. A drip tray T is provided at the front of the cabinet to catch dripping liquid when the door is opened.

Figures 18, 19:
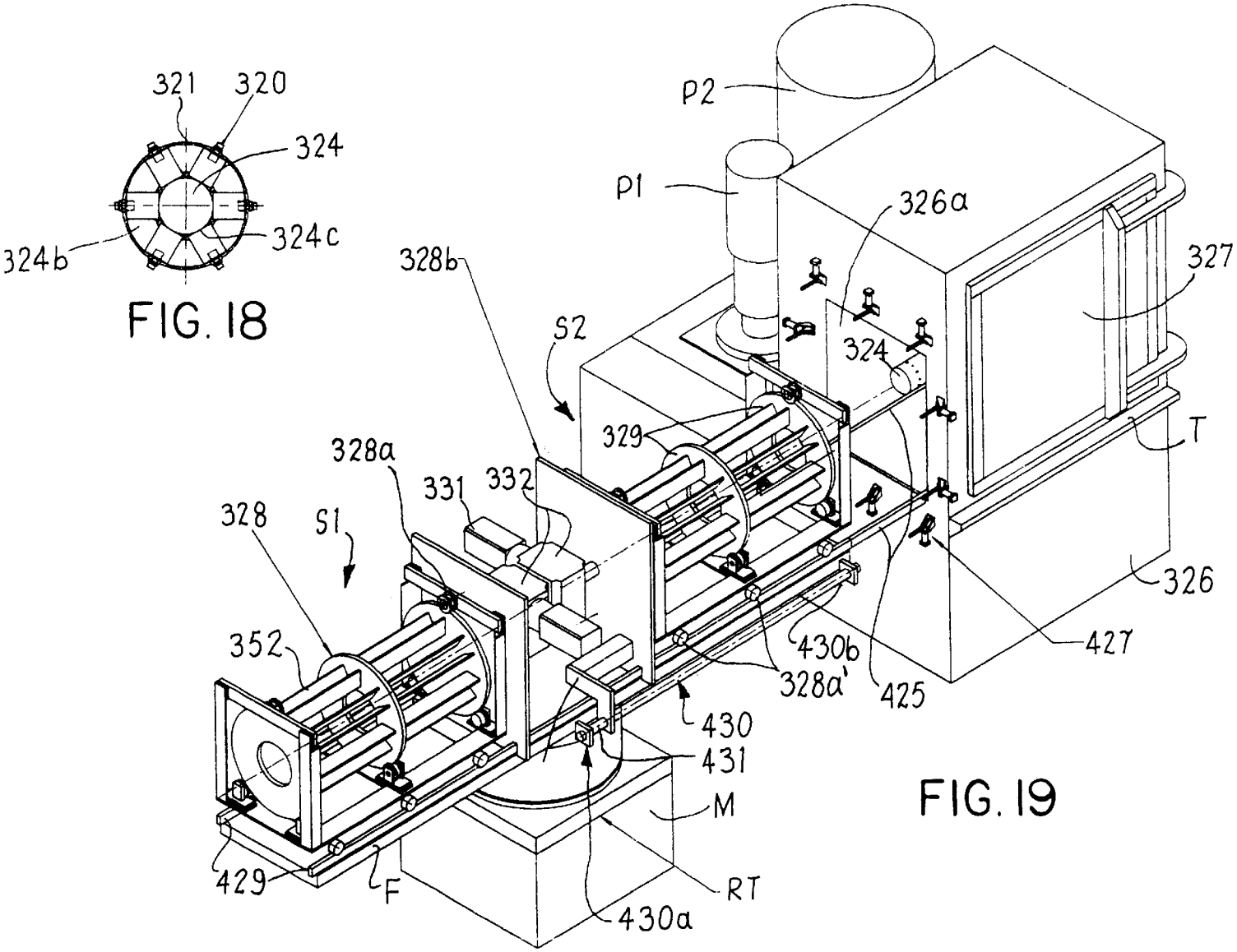
FIG. 18 is a transverse sectional view of the double wall fluid manifold of FIG. 17.
FIG. 19 is a perspective view of still another embodiment of apparatus of the invention.

As shown in FIG. 18, the fluid manifold 324 includes a double wall construction having an inner core dissolving fluid chamber 324*a* and outer compressed air chamber 324*b* defined by inner wall 324*c* of the manifold 324, both chambers having a constant diameter. Core dissolving fluid spray nozzles 320 are fastened to the inner wall 324*c* so as to communicate with core dissolving fluid chamber 324*a*. Air blow off (discharge) orifices 321 (diameter of 0.060 inch) are drilled in the outer manifold wall so as to communicate with the compressed air chamber 324*b*. The core dissolving fluid spray nozzles 320 (schematically shown) and air blow off orifices 321 (schematically shown-diameter 0.060 inch) are spaced circumferentially around the manifold in alternating manner in common planes along the length of the manifold such that each turbine blade casting 10''' fixtured on the carousels 325 (turbine blade castings shown fixtured only on a portion of the right-hand carousel in FIG. 17 for convenience) is aligned with a core dissolving fluid spray nozzle 320 and then an air blow off orifice 321 in repeated sequence as the carousels are rotated relative to the fluid manifold 324. At the nozzles 320, core dissolving fluid of the type described hereabove is sprayed under pressure at an exposed region of a core (not shown but like the core described hereabove), and at the air blow off orifices 321, compressed air is discharged at the same region of the castings 10''' to assist drainage of fluid and debris from the castings 10'''.

The carousel 325 includes carrier rings 329 at each end and at an intermediate region with each carrier ring 329 supported for rotation in FIG. 17 by a wheeled carousel support frame 328 (only one end and intermediate support frame section shown) disposed on the cabinet. The support frame 328 has wheels 328*a* spaced apart for engaging the carousel carrier rings 329 at circumferential ring locations. The rotary carousel 325 is directly driven to rotate by a drive shaft 330 of a gear reducer 332 coupled to a servo drive motor 331, the gear reducer and motor being disposed external of the cabinet 326 as shown.

The fluid manifold 324 is mounted on the cabinet wall in a manner described in previous figures to communicate to a caustic feed conduit or pipe that supplies hot caustic solution to the inner manifold chamber 324*a* from high pressure pump P2 (e.g. 400 psi). A relatively low pressure pump P1 (e.g. 75 psi) draws hot caustic solution through a pump suction pipe from a sump 343 in the bottom of the cabinet and supplies it to the high pressure pump P2. The caustic solution is drawn from a filter tank or box 345 in the sump 343 wherein the filter box includes filter screens 345*a* to prevent harmful debris from entering the pumps. The sump 343 receives caustic solution sprayed from the cabinet after spraying at the castings 10''' via floor filter screen 347 disposed below the carousels 325 as shown in FIG. 17. The outer compressed air chamber 324*b* of the manifold 324 receives compressed air via a manifold fitting proximate the caustic feed pipe to receive filtered, dried compressed air from a conventional source, such as shop air (not shown).

A serpentine heat exchanger (not shown but like that shown in FIG. 14) is disposed in the sump 343 submerged in the caustic solution therein and is heated by a gas-fired burner (not shown) disposed adjacent a side of the sump such that burner gases flow through the serpentine heat exchanger to heat the caustic solution to a suitable elevated temperature described hereabove. The heat exchanger vents combustion gases through a vent 350*a* in the top of the cabinet. The sump 343 has a main drain 343*b* for draining caustic solution and sludge or other debris therefrom. A cabinet wash manifold 349 is provided and extends into the sump 343 to introduce rinse water to flush out caustic solution and sludge or other debris from the sump. Other sump components, such as solution make-up valves and conduits, caustic solution level sensor (not shown), caustic solution temperature sensor S1, are provided to control the concentration and temperature of the caustic solution in the sump within selected operational ranges. An ambient vent V with a blower (not shown) is disposed on the top of the cabinet above and communicating with the internal chamber to provide a negative pressure therein relative to ambient to prevent steam from escaping the cabinet.

The apparatus of FIG. 17 functions in similar manner as apparatus described hereabove to remove core material from internal of the turbine blade castings 10'''. That is, the castings 10''' are rotated by carousel 325 in sequence past the circumferentially spaced apart core dissolving fluid spray nozzles 320 and then the air blow off orifices 321 on the stationary manifold 324 to progressively remove core material from internal of the castings. The castings 10''' can be rotated by carousels 325 continuously or intermittently relative to the fluid nozzles 320 and air blow off orifices 321 to this end as described hereabove.

In the embodiment of FIG. 19, the carousel support frame 328 can be mounted on rails 425 that extend into the cleaning cabinet 326 through a side access opening 326*a* of the cabinet. The carousel support frame 328 includes rollers 328*a*' that allow the carousel 325 thereon to be rolled into/out of the cabinet relative to the fixed fluid manifold 324 and a fixed end panel 328*b* that functions to close off the opening 326*a* when the carousel 325 is positioned in the cabinet 326 about the fluid manifold 324 for the core removal operation. A set of pneumatic or other clamps 427 are operative to engage the end panel 328*b* to lock and seal the end panel relative to the cabinet opening 326*a*. A rotary table RT is disposed proximate the cabinet opening 326*a* and includes two stations S1, S2 having a frame F supporting a pair of rails 429 that can be aligned with the rails 425 that are disposed inside and outside the cabinet by rotation of the table by a rotary motor M (shown schematically) in order to allow the carousel 325 to be rolled into/out of the cabinet 326 on the aligned rails. Each station S1, S2 can receive a carousel 325/frame 328 such that one carousel can be loaded with castings outside the cabinet 325, while the other, already loaded carousel/support frame is positioned in the cabinet. A ball screw drive 430 is mounted on the table frame F at each station S1, S2 with one ball screw end 430*a* connected to the respective end panel 328*a* via a ball nut 431 and bracket 433 and the other ball screw end 430*b* connected to the table frame. A motor (not shown) is provided proximate and connected to the ball screw end 430*a* to rotate the ball screw to move the respective carousel 325 into/out of the cabinet.

The carousel 325 positioned in the cabinet about the fixed fluid manifold 324 is rotated by the motor 331 and gear reducer 332 disposed adjacent the respective end panel 328*b* on the carousel support frame 328.

The other features of the cabinet are similar to those described hereabove in FIG. 17 and bear like reference numerals.

Although the invention has been described with respect to certain specific embodiments thereof, those skilled in the art will recognize that these embodiments were offered for purposes of illustration rather than limitation and that the invention is not limited thereto but rather only as set forth in the appended claims.

The embodiments of the invention in which an exclusive property or privilege is claimed are defined as follows:

1. A method of removing a ceramic core from inside a metallic casting, comprising:

disposing the casting and a fluid spray means in a manner that an exposed region of the core is contacted by a caustic core dissolving fluid discharged from said fluid spray means, discharging the core dissolving fluid from said fluid spray means at the exposed core region to contact the exposed core region and remove core material therefrom and expose further regions of the core residing within the casting, and discharging the core dissolving fluid to contact the further regions of the core residing within the casting to remove core material therefrom as they become exposed to the core dissolving fluid as core material is removed.

2. The method of claim 1 wherein the discharge of core dissolving fluid from said means is interrupted periodically to allow dissolved core material and spent fluid to drain from the casting.

3. The method of claim 1 wherein said casting and said fluid spray means are relatively moved so that said core dissolving fluid can drain at a drain location spaced from said means.

4. The method of claim 1 wherein said casting is moved relative to a gas discharge means directed at said casting to force core dissolving fluid out of said casting.

5. The method of claim 1 wherein the casting and a plurality of fluid spray nozzles are relatively moved so that the casting is moved from one fluid spray nozzle to the next to contact the core with core dissolving fluid at each nozzle and to drain dissolved core material and spent fluid from the casting when it is moved to a drain location between the means.

6. The method of claim 5 wherein a plurality of said castings are carried on a linearly movable carrier past a plurality of stationary core dissolving fluid spray means to remove the core from each casting.

7. The method of claim 5 wherein a plurality of said castings are carried on a rotatable carrier past a plurality of stationary core dissolving fluid spray nozzles.

8. The method of claim 7 wherein said plurality of said castings are carried on a carousel past a plurality of core dissolving fluid spray nozzles disposed on a stationary central manifold located at the rotational axis of said carousel.

9. The method of claim 8 wherein the caustic solution is at a temperature of 100 to 150° C. and pressure of 50 to 450 psi.

10. The method of claim 1 wherein the core dissolving fluid comprises a caustic solution at elevated temperature and pressure.

11. A method of removing a ceramic core from inside a metallic turbine blade or vane casting having an airfoil portion and root portion with a region of the core exposed at the root portion, comprising:

disposing the casting and fluid spray means in a manner that the exposed region of the ceramic core at the root portion is contacted by a caustic core dissolving fluid discharged from said fluid spray means, discharging the core dissolving fluid from said fluid spray means at the exposed core region to contact the exposed core region and remove core material therefrom at the root portion and expose further regions of the core residing within the airfoil portion, and discharging the core dissolving fluid to contact the further regions of the core residing within the casting at the airfoil portion to remove core material therefrom as they become exposed to the core dissolving fluid as core material is removed.

12. The method of claim 11 wherein the discharge of core dissolving fluid from said means is interrupted periodically to allow dissolved core material and spent fluid to drain from the casting.

13. The method of claim 11 wherein said casting and said fluid spray means are relatively moved so that said casting can drain at a drain location apart from said means.

14. The method of claim 1 wherein said casting is moved relative to a gas discharge means directed at said casting to force core dissolving fluid out of said casting.

15. The method of claim 11 wherein the casting and a plurality of fluid spray nozzles are relatively moved so that the casting is moved from one fluid spray nozzle to the next to contact the core with core dissolving fluid at each nozzle and to drain dissolved core material and spent fluid from the casting when it is moved to a drain location between the nozzles.

16. The method of claim 15 wherein a plurality of said castings are carried on a linearly movable carrier past a plurality of stationary core dissolving fluid spray nozzles to remove the core from each casting.

17. The method of claim 16 wherein a plurality of said castings are carried on a rotatable carrier past a plurality of stationary core dissolving fluid spray nozzles.

18. The method of claim 17 wherein said plurality of said castings are carried on a carousel past a plurality of core dissolving fluid spray nozzles disposed on a stationary central manifold located at the rotational axis of said carousel.

19. The method of claim 11 wherein the core dissolving fluid comprises a caustic solution at a temperature of 100 to 150° C. and pressure of 50 to 450 psi.

20. The method of claim 11 wherein an additional core dissolving fluid spray nozzle is positioned for discharging core dissolving fluid at a casting tip where another region of the core may be exposed at a tip plenum cavity of said casting.

* * * * *